US009526280B2

(12) United States Patent
Robinson

(10) Patent No.: US 9,526,280 B2
(45) Date of Patent: Dec. 27, 2016

(54) ARTICLE TO PROTECT THUMB

(76) Inventor: Dennie Robinson, Muscle Shoals, AL (US)

( * ) Notice: Subject to any disclaimer, the term of this patent is extended or adjusted under 35 U.S.C. 154(b) by 483 days.

(21) Appl. No.: 13/431,148

(22) Filed: Mar. 27, 2012

(65) Prior Publication Data

US 2013/0254964 A1 Oct. 3, 2013

(51) Int. Cl.
*A63B 71/14* (2006.01)
*A41D 13/08* (2006.01)

(52) U.S. Cl.
CPC ..... *A41D 13/087* (2013.01); *A63B 71/14* (2013.01); *A63B 71/141* (2013.01); *A63B 71/143* (2013.01); *A63B 2102/18* (2015.10); *A63B 2102/22* (2015.10); *A63B 2243/0025* (2013.01)

(58) Field of Classification Search
USPC ..... 2/16, 19, 160, 161.1, 161.6, 163
See application file for complete search history.

(56) References Cited

U.S. PATENT DOCUMENTS 4,062,540 A * 12/1977 Calentine ..... 473/60
4,658,441 A * 4/1987 Smith ..... 2/16
5,561,856 A * 10/1996 Pesco ..... 2/16
6,532,963 B2 * 3/2003 Swanbeck ..... 128/880
7,431,671 B1 * 10/2008 Frost ..... A63B 69/0002 2/20

* cited by examiner

*Primary Examiner* — Katherine Moran
(74) *Attorney, Agent, or Firm* — George P. Kobler; David W. Barman

(57) ABSTRACT

The present invention is an article for supporting a thumb in a glove or sports glove having a circular main body, said body defining a thumb insertion cavity; a double curved surface of said body, said double curve having a first major curve being a concave curve surface portion, said concave curve terminating in and coupled with a convex curve surface portion; a support platform, generally on an upper edge of said main body; and a knuckle support, extending upward from said support platform; said article constructed and arranged such that the most distal thumb knuckle extends above a top ridge of said knuckle support.

8 Claims, 6 Drawing Sheets

ARTICLE TO PROTECT THUMB

BACKGROUND OF THE INVENTION

Field of the Invention

In baseball the position of catcher is one that requires a particularly elevated amount of skill. The catcher actually catches the baseball approximately 100 times or more in a given nine-inning game. This amount of catching a baseball thrown by a pitcher at elevated velocities presents particular physical difficulties for the catcher. Protective equipment has developed and evolved through the years. Most noteworthy is the appearance of the large padded catcher's glove. The catcher's glove formed with additional padding to protect the catcher's hand when catching baseballs thrown at high velocity. Although there have been great strides to provide protective equipment to protect a catcher, injuries at this position are still amongst the highest in any other position in baseball. One particular area of injury are injuries to the thumb on the catching hand. Although the catcher's mitt has additional padding around the thumb, ball of the thumb, and palm areas, there still are injuries caused by the movement of the thumb in directions that are adverse to normal anatomical motion. A great need exists to provide protection for the thumb while not interfering with the motion of the thumb. In the sport of soccer, it is common for the goalkeeper to wear a glove that prevents the four fingers (other than the thumb) from extending and bending in a backward or dorsal direction away from the palm of the hand. However, such a glove would not help in baseball because the thumb has such a wide degree of motion and the motion is required for the proper playing of the catcher position. Therefore, there is a need for some type of protective equipment that will protect the thumb from adverse movement and still allow a catcher to properly play the position.

Although the present invention was initially developed with baseball in mind, the invention is equally applicable to all sports where a glove is worn and particular degrees of thumb movement require protection. This would include, but not be limited to, hockey/soccer goalies, cricket, and others.

SUMMARY OF THE INVENTION

The present invention addresses the need for a protective piece of equipment by providing movement of the thumb to a particular degree. The catcher will still be able to wear the article of the present invention and move the thumb as needed. However, movement of the thumb in a plane that is formed with the palm of a hand (this being referred to an "X" plane) will still be allowed to some extent. The article of the present invention will prevent a hyperextension of the thumb of in the "X" plane when the thumb is moving in an abduction movement. This being a radial abduction movement. As referred to herein, the "Z" plane is the plane substantially perpendicular to the "X" plane.

In one embodiment, the article of the present invention is constructed of a single unitary piece.

In one embodiment, the present invention is an article for supporting a thumb in a baseball glove, sports glove, work glove, and the like, said article comprising:

a circular, said body defining a thumb insertion cavity;

a double curved surface of said body, said double curve having a first major curve being a concave curve surface portion, said concave curve terminating in and coupled with a convex curve surface portion;

a support platform;

a knuckle support;

said article constructed and arranged such that the most distal thumb knuckle extends above a top ridge of said knuckle support;

The article is preferably formed of a rigid material such as plastic or similar materials.

When the article is worn on the thumb of a user, radial abduction of said thumb is restricted by said article.

In one embodiment, when wearing the article, radial abduction of the thumb is restricted to an angle 80° or less, relative to an adjacent index finger, when the index finger is in a natural or extension position extending outward from a palm of a hand.

However, when the article is on the thumb of the user, palmer abduction of the thumb is substantially unrestricted.

Furthermore, when worn on the thumb, adduction of the thumb is substantially unrestricted when wearing said article.

Additionally, the article, when worn on the thumb, restricts extension of the thumb in the z plane.

In one embodiment, when wearing the article, extension of the thumb in the z plane is restricted to an angle of 45° or less relative to the x plane.

DETAILED DESCRIPTION OF THE PREFERRED EMBODIMENT

Figure 7:
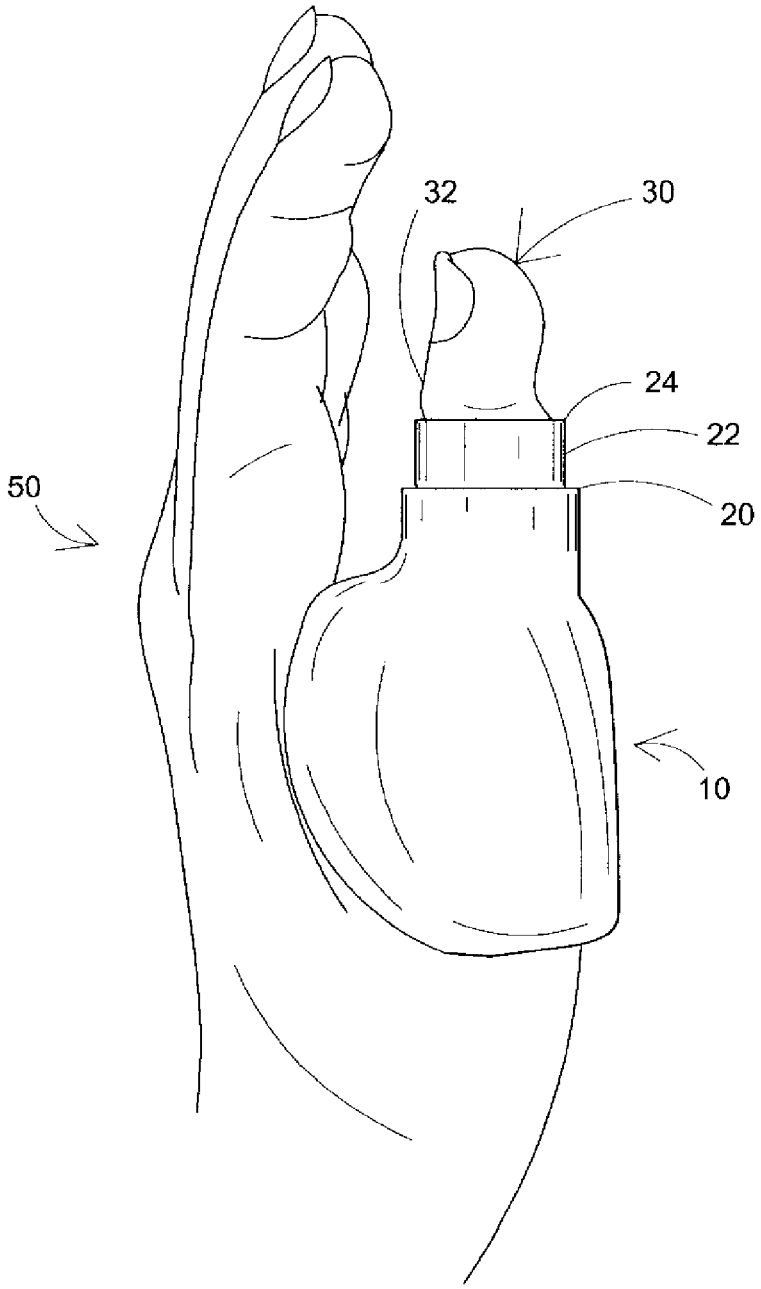
FIG. 7 is a side view of a hand wearing the support of the present invention.
Figure 8:
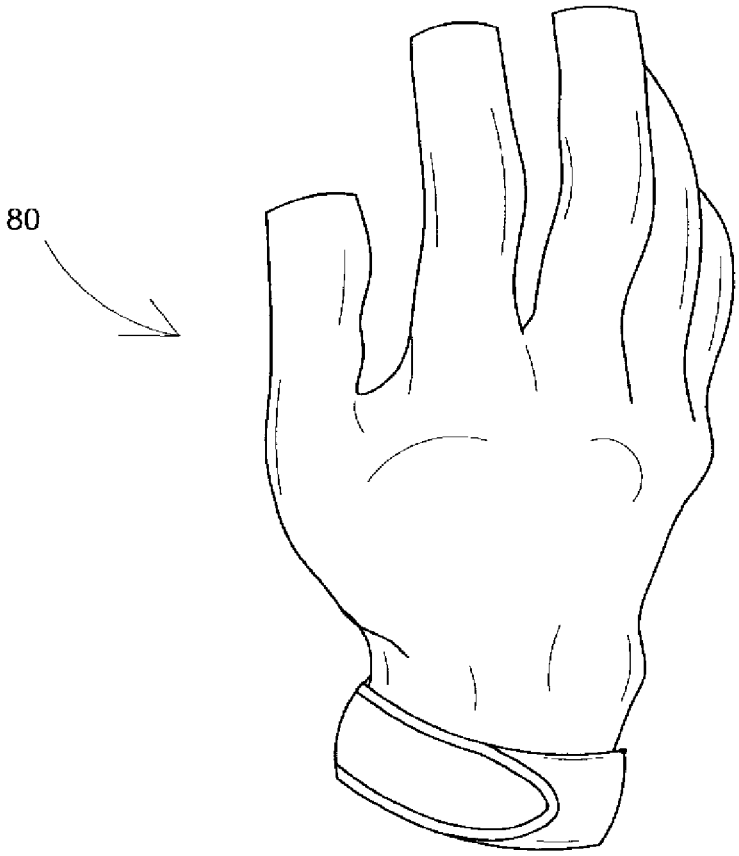
FIG. 8 is one example of a glove to be worn over a hand wearing the support of the present invention.

The present invention relates generally to a support 10 to be worn by baseball players playing the position of catcher, soccer goalies, hockey goalies, and other environments where there is a desire to provide particularized restriction to thumb movement. The position of catcher presents unique difficulties in that the speed of a baseball pitched toward the catcher's glove is of much gi eater velocity than any other speed in the field of play in a game of baseball. Support 10 is constructed and arranged to be placed directly on the thumb of a catcher. Support 10 generally has an interior cavity 12 through which the thumb is placed. Support 10 has a generally vertical curved portion 14 and a convex curvature portion 16. Convex curvature portion 16 extends a distance greater than half of the length of article 10 and terminates in a concave curvature portion 18. Concave curvature 18 terminates and forms support platform 20. The unique concave-convex combined curvature allows for the article to be particularly positioned, provide desired range of motion, and, as will be further discussed, restrict adverse motion in both the "X" and "Z" planes. Support platform 20 has integral therewith knuckle support 22 that terminates in an upper most ridge 24. As best seen in FIG. 7 thumb 30 extends outward from support 10 such that knuckle 32 is able to flex.

Figure 1:
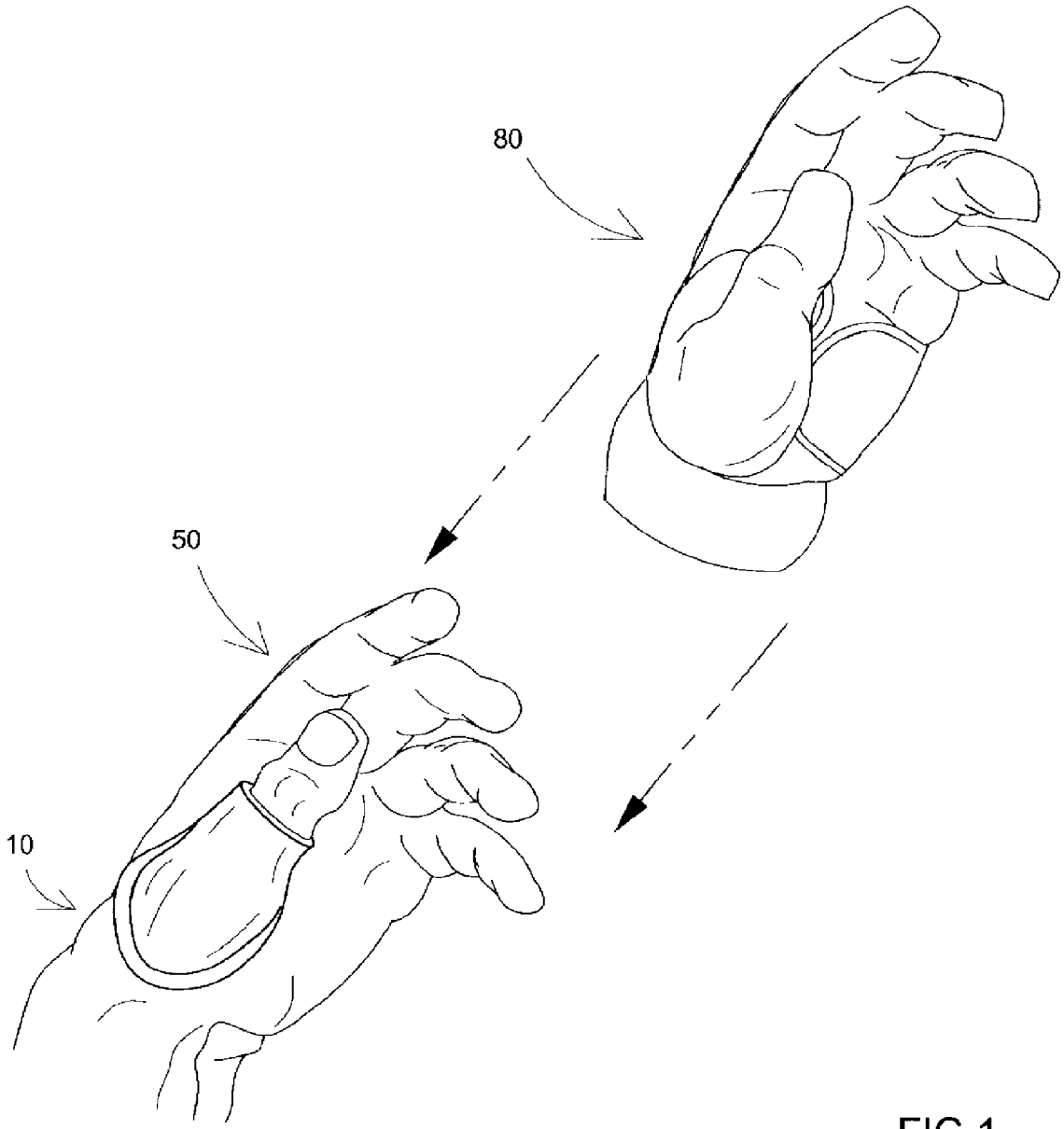
FIG. 1 shows the support of the present invention prior in position on a hand prior to being overlaid with a supporting glove.
Figure 4:
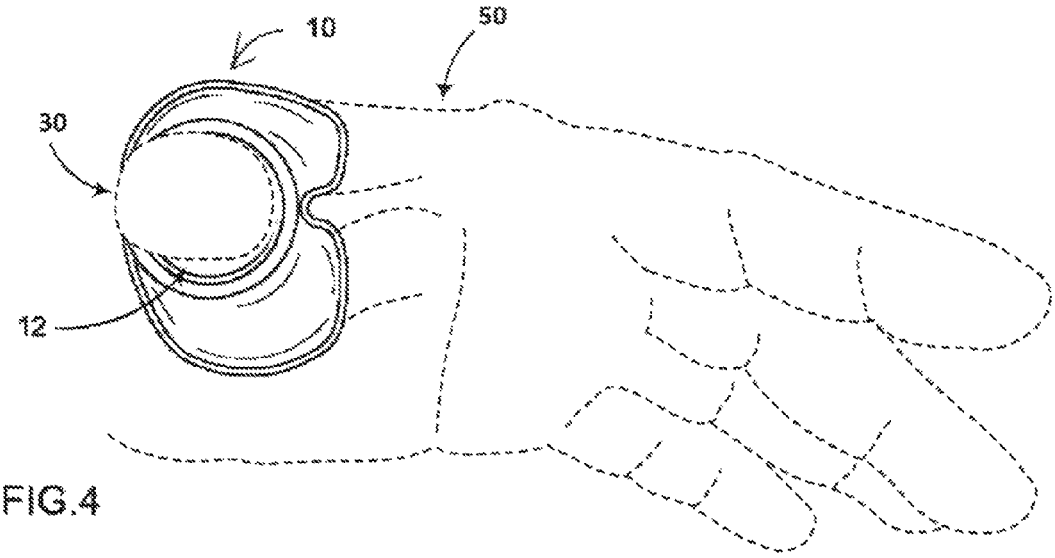
FIG. 4. is a top view of the support of the present invention.
Figure 3:
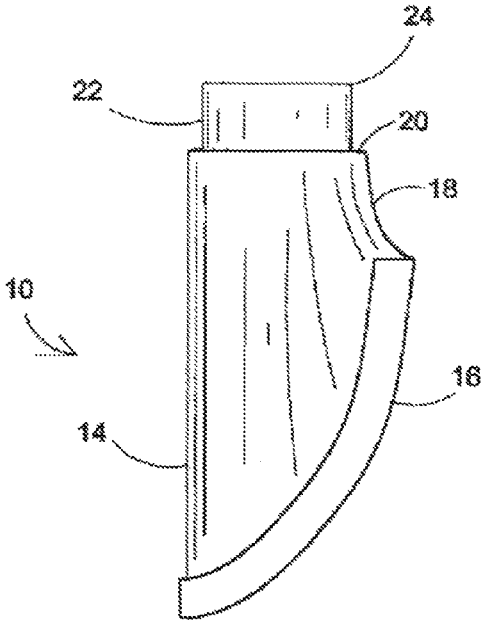
FIG. 3 is a side view of the support view of the present invention.
Figure 2:
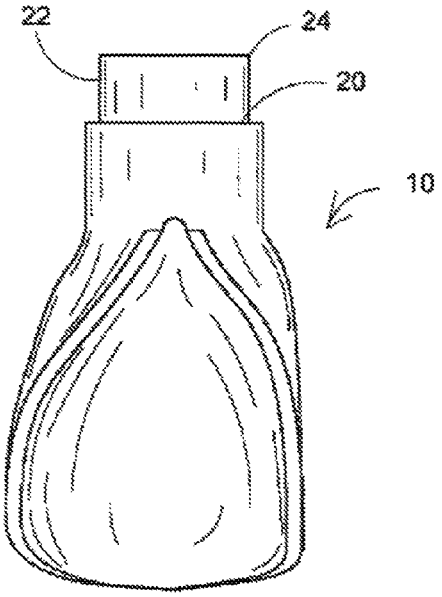
FIG. 2 is a front view of the support of the present invention.
Figure 5:
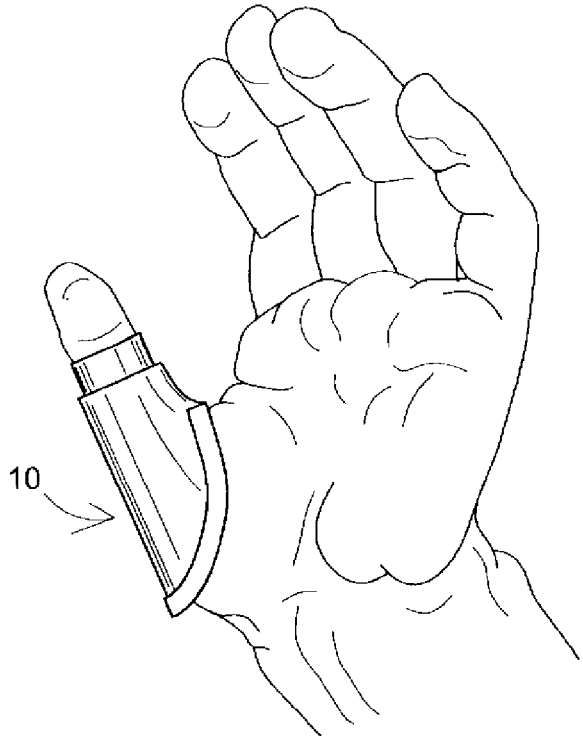
FIG. 5 is a front perspective view showing the support of the present invention.

Although article 10 is shown configured for the left hand it can be constructed and arranged to work on either hand. In use article 10 is positioned on hand 50 by inserting a user's thumb 30 through interior cavity 12 of article 10 such that knuckle 32 protrudes outward from the top ridge 24 of knuckle support 22. Although not an absolute requirement to practice the present invention, one preferred embodiment provides for the placement of a glove 80 over hand 50 that has article 10 attached thereto, as shown in FIG. 1. Glove 80 is commonly worn by baseball catchers inside a catcher's mitt (not shown) in order to provide additional support for a catcher.

Figure 6:
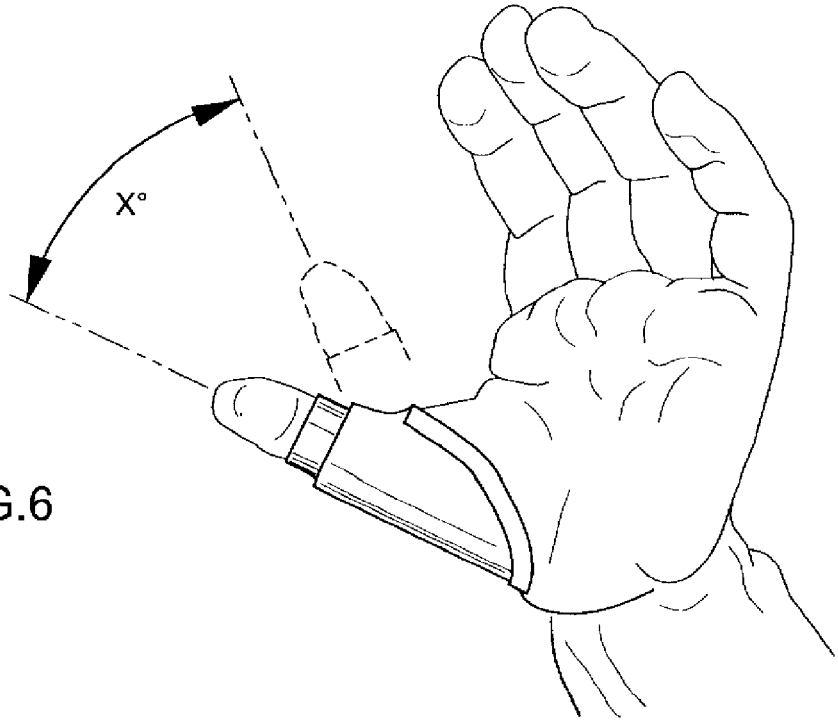
FIG. 6 is a front perspective view showing motion of the thumb and restriction thereof.
Figure 10:
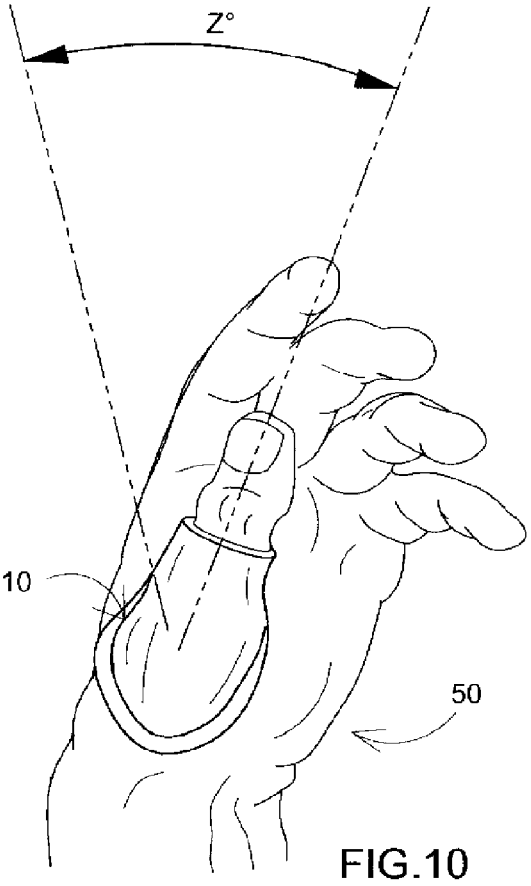
FIG. 10 is a front perspective view showing the thumb and relating to restriction of motion in the "Z" plane.
Figure 9:
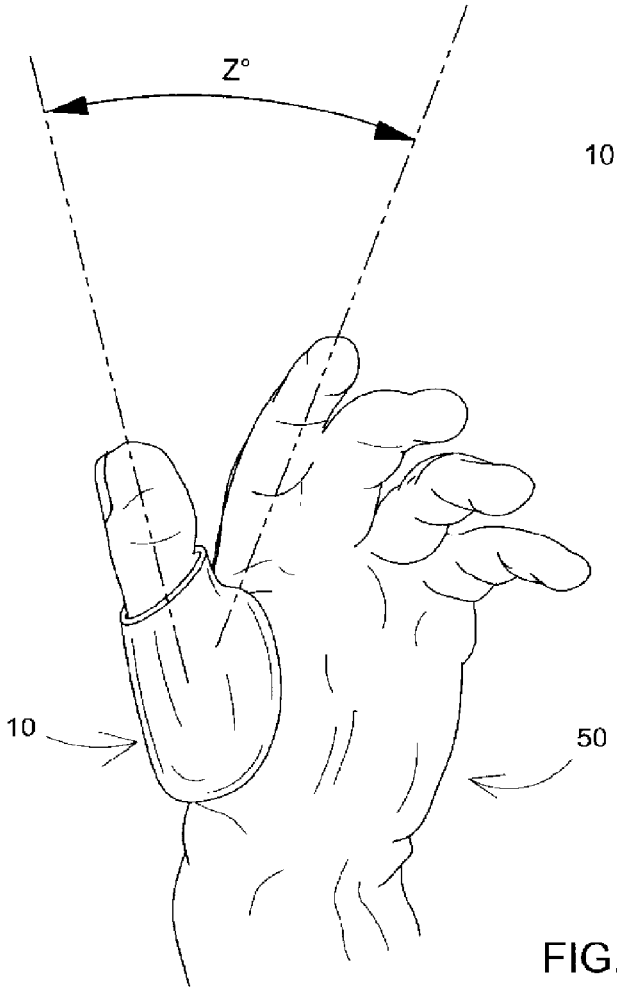
FIG. 9 is a front perspective view showing the thumb in position while wearing the support of the present invention.

As a frame of reference a flatly extended hand forms a substantial planer surface along the palm portion of the hand. This will be referred to as the "X" plane. Thumb 30 extends outward from the hand in an radial abduction manner and is restricted from fully extending. The extension is noted in degrees as shown by "X" degrees in FIG. 6. This prevents a hyperextension in the radial abduction movement in the thumb when catching a baseball. Using the same frame of reference as a "X" plane there is perpendicular to the "X" plane a "Z" plane. The thumb can extend in a dorsal manner away from the palm or "X" plane. This movement along the "Z" plane is shown in FIGS. 9 and 10. In use article 10 prevents hyper extensive motion of thumb 30 in either the "X" or "Z" plane. Article 10 thus prevents hyper extensive injuries from occurring in a variety of situations. It is additional noteworthy that although article 10 limits the radial abduction movement thumb 30 can be substantially completely adducted. Further, although FIG. 6 shows limits radial abduction article 10 does not significantly inhibit palmar abduction. This is the movement of the thumb across the palm of the hand. It is important that palmar abduction not be constricted because the action of palmar abduction when wearing a baseball glove is in fact part of the mechanism by which one closes the baseball glove around the baseball being caught.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. An article for supporting a thumb in a glove, said article comprising: a tubular main body, said body defining a thumb insertion cavity; a double curved surface of said body, said double curve having a first major curve being a concave, curve surface portion, said concave curve terminating in and coupled with a convex curve surface portion sharing an inflection point; a support platform disposed near an end of said main body distal from said inflection point; a knuckle support, extending from said support platform; said article constructed and arranged such that a user's most distal thumb knuckle extends above a top ridge of said knuckle support.

2. The article of claim 1 wherein said article is formed of a rigid material.

3. The article of claim 1 wherein radial abduction of said thumb is restricted by said article.

4. The article of claim 1 wherein radial abduction of said thumb is restricted to an angle 80° or less, relative to an adjacent index finger, when the index finger is in a natural or extension position extending outward from a palm of a hand.

5. The article of claim 1 wherein palmer abduction of said thumb is substantially unrestricted when wearing said article.

6. The article of claim 1 wherein adduction of said thumb is substantially unrestricted when wearing said article.

7. The article of claim 1 wherein range of motion of the thumb relative to an x plane, a y plane and a z plane, in the z plane is restricted.

8. The article of claim 1 wherein range of motion of the thumb relative to an x plane, a y plane and a z plane, in the plane is restricted to an angle of 45° or less relative to the x plane.

* * * * *